US008142552B2

(12) United States Patent
Meister et al.

(10) Patent No.: US 8,142,552 B2
(45) **Date of Patent: *Mar. 27, 2012**

(54) FILTER PURGE SYSTEM UTILIZING A REACTIVE PROPELLANT

(75) Inventors: Steven Francis Meister, Chillicothe, IL (US); Loran Hoffman, Washington, IL (US); Thomas V. Staley, Peoria, IL (US); Philip Stephen Bruza, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 1026 days.

This patent is subject to a terminal disclaimer.

(21) Appl. No.: 11/819,878

(22) Filed: Jun. 29, 2007

(65) Prior Publication Data

US 2009/0000478 A1 Jan. 1, 2009

(51) Int. Cl.
*B01D 46/00* (2006.01)

(52) U.S. Cl. ..... 95/278; 55/282.3; 55/293; 55/DIG. 30; 55/DIG. 10; 95/279

(58) Field of Classification Search ..... 55/292, 55/283, 302, 304–305; 95/279, 278; 96/241; 134/17

See application file for complete search history.

(56) References Cited

U.S. PATENT DOCUMENTS

| | | | | |
|---|---|---|---|---|
| 3,213,804 | A | | 10/1965 | Sobey |
| 3,887,341 | A | | 6/1975 | Sutter |
| 3,948,623 | A | | 4/1976 | Paradis et al. |
| 4,502,278 | A | * | 3/1985 | Stark ..... 60/303 |
| 4,624,689 | A | * | 11/1986 | Volk et al. ..... 96/397 |
| 4,655,799 | A | | 4/1987 | Bosworth et al. |
| 4,833,883 | A | | 5/1989 | Oda et al. |
| 4,875,335 | A | | 10/1989 | Arai et al. |
| 4,875,336 | A | | 10/1989 | Hayashi et al. |
| 4,992,021 | A | | 2/1991 | Langen et al. |
| 5,351,619 | A | * | 10/1994 | Chan et al. ..... 102/289 |
| 5,397,550 | A | | 3/1995 | Marino, Jr. |
| 5,421,845 | A | | 6/1995 | Gregg et al. |
| 5,616,171 | A | | 4/1997 | Barris et al. |
| 5,634,952 | A | | 6/1997 | Kasai et al. |
| 5,701,735 | A | | 12/1997 | Kawaguchi |
| 5,711,234 | A | | 1/1998 | Uhlemann et al. |
| 5,725,618 | A | | 3/1998 | Shimoda et al. |
| 6,010,547 | A | | 1/2000 | Jeong et al. |
| 6,037,291 | A | | 3/2000 | Buckley et al. |
| 6,497,095 | B2 | | 12/2002 | Carberry et al. |
| 6,565,636 | B1 | | 5/2003 | Thompson |

(Continued)

FOREIGN PATENT DOCUMENTS

| | | |
|---|---|---|
| DE | 38 08 075 | 9/1989 |

(Continued)

OTHER PUBLICATIONS

Office Action from U.S. Appl. No. 11/819,873 mailed on Apr. 1, 2010 (13 pages).

*Primary Examiner* — Duane Smith
*Assistant Examiner* — Karla Hawkins
(74) *Attorney, Agent, or Firm* — Finnegan, Henderson, Farabow, Garrett & Dunner LLP

(57) ABSTRACT

A system for removing matter from a filtering device is disclosed. The system may have a reactive propellant located downstream of the filtering device. The reactive propellant may be configured to generate an impact wave.

20 Claims, 4 Drawing Sheets

U.S. PATENT DOCUMENTS

| | | | |
|---|---|---|---|
| 6,641,646 | B2 | 11/2003 | Rosenberg |
| 6,755,016 | B2 | 6/2004 | Dittler et al. |
| 6,835,224 | B2 | 12/2004 | Cheng |
| 7,025,811 | B2 | 4/2006 | Streichsbier et al. |
| 7,047,731 | B2 | 5/2006 | Foster et al. |
| 2004/0112218 | A1 | 6/2004 | Steiner |
| 2004/0226290 | A1 | 11/2004 | Bailey |
| 2007/0000520 | A1 | 1/2007 | Steen et al. |
| 2007/0137150 | A1 | 6/2007 | Goddard |
| 2008/0092525 | A1* | 4/2008 | Ehlers ..... 60/286 |

FOREIGN PATENT DOCUMENTS

| | | | |
|---|---|---|---|
| EP | 0220588 | | 5/1987 |
| EP | 0 930 422 | A1 | 7/1999 |
| EP | 1 698 765 | A1 | 9/2006 |
| JP | 4-31613 | | 2/1992 |
| JP | 7-54632 | | 2/1995 |
| JP | 7-63038 | | 3/1995 |

* cited by examiner

FILTER PURGE SYSTEM UTILIZING A REACTIVE PROPELLANT

TECHNICAL FIELD

The present disclosure relates generally to a system for purging a filter, and more particularly, to a purge system that uses a reactive propellant.

BACKGROUND

Internal combustion engines, including diesel engines, gasoline engines, gaseous fuel-powered, and other engines known in the art exhaust a complex mixture of air pollutants. The air pollutants may be composed of gaseous compounds, as well as solid particulate matter. Due to increased attention on the environment, exhaust emission standards have become more stringent, and the amount of gaseous compounds and particulate matter emitted to the atmosphere from an engine may be regulated depending on the type of engine, size of engine, and/or class of engine.

One method that has been implemented by engine manufacturers to comply with the regulation of air pollutants exhausted to the environment has been to remove these pollutants from the exhaust flow of an engine with filters. However, extended use and repeated regeneration of such filters may cause matter to build up in the filters, thereby reducing filter functionality and engine performance.

One method of removing matter from a filter may be to divert an exhaust flow from the clogged filter to a separate filter, without disconnecting either filter from the engine. While the exhaust flow is diverted, air may be directed through the clogged filter in a direction opposite the normal flow. Although functionally adequate, the second filter may increase the cost and size of the filter system. In addition, matter that is located out of the direct path of the reverse flow may be insufficiently removed from such systems.

U.S. Pat. No. 5,725,618 (the '618 patent) issued to Shimoda on Mar. 10, 1998, discloses an alternative system for removing particulate matter from an engine filter. In particular, the '618 patent discloses a particulate filter connected to an engine exhaust line and an impact air valve structure located within the exhaust line and downstream of the particulate filter. When the particulate filter is clogged with accumulated particulates, an impact wave is generated by instantly releasing air fed to a pressure accumulating chamber of the impact air valve. When the impact wave is transferred to a downstream face of the particulate filter in a reverse flow direction, it removes captured particulates from the filter. Following removal of the particulates from the filter, the particulates may be burned away upstream of the filter. In this manner, the '618 patent may remove particulate matter from an entire cross-section of the filter without the use of a secondary filter system.

Although the system of the '618 patent may improve the amount of particulate matter dislodged from a filter, the system requires an impact air valve in order to generate the reverse flow condition and the additional impact air valve increases the overall cost and size of the system. Furthermore, the system of the '618 patent may not provide an impact wave of optimal force and duration for removing particulate matter.

The present disclosure is directed to overcoming one or more of the problems set forth above.

SUMMARY OF THE INVENTION

In one aspect, the present disclosure is directed to a system for removing matter from a filtering device. The system includes a reactive propellant located downstream of a filtering device. The system further includes an impact wave generated by the reactive propellant and directed across the filtering device.

In another aspect, the present disclosure is directed toward a method of removing matter from a filtering device. The method includes initiating an oxidizing reaction. The method further includes generating an impact wave from the oxidizing reaction and directing the impact wave across the filtering device.

DETAILED DESCRIPTION

Figure 1:
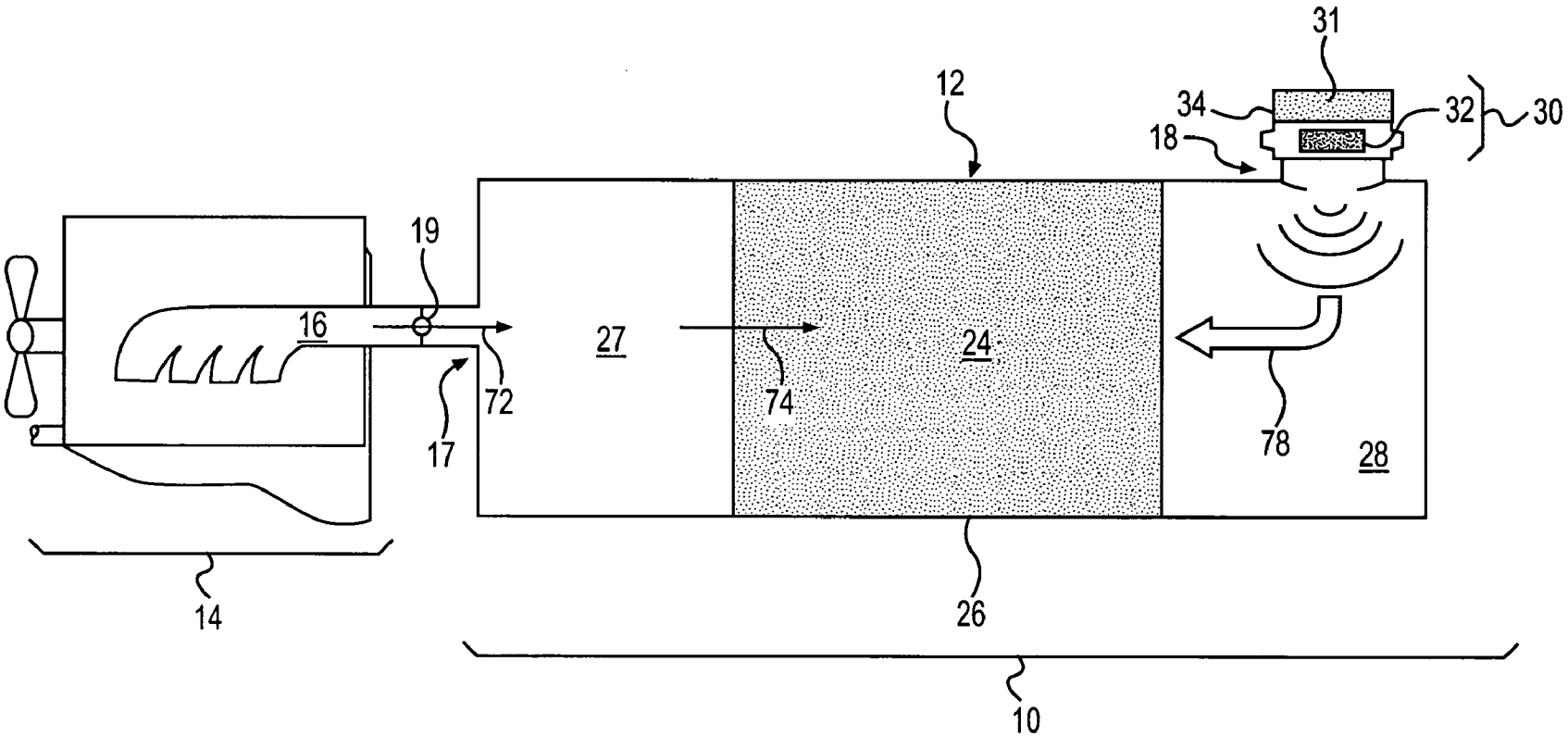
FIG. 1 is a diagrammatic illustration of an exemplary disclosed filter purge system.

FIG. 1 illustrates an exemplary embodiment of a filter purge system 10. In some embodiments of the present disclosure, filter purge system 10 may include a filter 12 connected to an internal combustion engine 14 such as, for example, a diesel engine. Engine 14 may include an exhaust line 16 connecting an exhaust flow of engine 14 with an inlet 17 of filter 12. Engine 14 may also include a turbine (not shown) connected to exhaust line 16. In such an embodiment, inlet 17 of filter 12 may be connected to an outlet of the turbine. An outlet 18 may be positioned downstream of filter 12 and allow the exhaust flow to pass from filter 12.

An inlet valve 19 may be disposed within exhaust line 16 of engine 14 and upstream of inlet 17. Inlet valve 19 may be a two-way, three-port valve that may selectively allow an exhaust flow of engine 14 to pass through filter 12. In some situations, inlet valve 19 may block communication between engine 14 and filter 12. For example, during operation of filter purge system 10, inlet valve 19 may be selectively positioned to direct flow from filter purge system 10 to the atmosphere or a receptacle, rather than into engine 14, in order to prohibit dislodged matter from flowing back into engine 14. Inlet valve 19 may be controlled and/or actuated by any means known in the art, such as, for example by a solenoid or via hydraulics, pneumatics, or manual means. Alternatively or additionally, exhaust line 16 may be removably attached to inlet 17 and may be uncoupled from filter 12 during operation of filter purge system 10 (not shown).

Filter 12 may include a filter media 24 fabricated from, for example, a cordierite, sintered metal, or silicon carbide material. In some embodiments of the present disclosure, filter media 24 may be coated with or otherwise contain a catalyst capable of reducing or converting soot, NOx, sulfur compounds, particulate matter and/or other pollutants known in the art to innocuous substances. Such catalyst materials may include, for example, alumina, platinum, rhodium, barium, cerium, and/or alkali metals, alkaline-earth metals, rare-earth metals, or combinations thereof. Filter media 24 may be formed into a honeycomb structure, a mesh structure, or any other structural configuration to maximize a surface area available for the filtering of material (i.e. particulate matter).

Filter 12 may also include a filter housing 26 configured to contain and support filter media 24. An inlet end cap 27 of filter housing 26 may be defined as the portion of filter housing 26 located upstream of filter media 24 to receive a flow of exhaust. An outlet end cap 28 of filter housing 26 may be defined as the portion of filter housing 26 located downstream of filter media 24 to discharge the flow of exhaust.

One or more sensors (not shown) may be disposed within outlet end cap 28 and/or internal to filter 12. The sensor may embody any sensing device known in the art such as, for example, a flow meter, an emission sensor (i.e. a NOx sensor), a temperature sensor, a pressure transducer, or other sensor. The sensor may sense, for example, an increase in the pressure drop across filter media 24, indicating a saturation of filter media 24. The sensor may send a signal indicative of the pressure drop to a controller or other device (not shown), and may assist in, for example, triggering filter regeneration and/or operation of filter purge system 10. It is further considered that one or more sensors may be located upstream of filter media 24.

Filter purge system 10 may further include a propellant system 30 mechanically attached to outlet 18 by any means such as, for example, by threaded fastening. Propellant system 30 may include a propellant 31 and an igniter 32 contained, for example, in a single cartridge 34 with a single ignition point. It is considered that igniter 32 may be any device that provides an electrical spark to propellant 31. The ignition of propellant 31 may result in an impact wave (i.e. a fast moving wave of gas). It is further considered that a timing device (not shown) may control igniter 32 and may be used to trigger multiple combustion events of propellant 31. For example, the timing device may trigger igniter 32 to initiate reactions of propellant 31 at intervals of about 100 ms. The quantity and geometry of propellant 31 may be controlled to achieve a reaction that results in an impact wave with a mass flow rate of for example, about 15 kg/sec and a duration of at least about 10 ms. The interval between reactions, duration of the impact wave, and the mass flow rate may be dependant upon the quantity of and geometry of propellant 40, as well as the geometry of filter 12. It is further considered that propellant system 30 may be attached for removal during operation of engine 14 so that it does not interfere with the flow of exhaust through outlet 18.

Propellant 31 may be a reactive propellant i.e., a material that is capable of an oxidizing reaction. Propellant 31 may embody a solid propellant, the reactants and products of which may not damage the catalyst coating of filter media 24. For example, it is considered that propellant 31 may be a combination of guanylurea dinitramide ($C_2H_7N_7O_5$, also referred to GUDN) and ammonium nitrate ($N_2H_4O_3$, also referred to as AN). The oxidation of GUDN with AN may result in carbon dioxide ($CO_2$), nitrogen ($N_2$) and water vapor ($H_2O$), compounds that may be inert to the catalyst coating of filter media 24.

Figure 2:
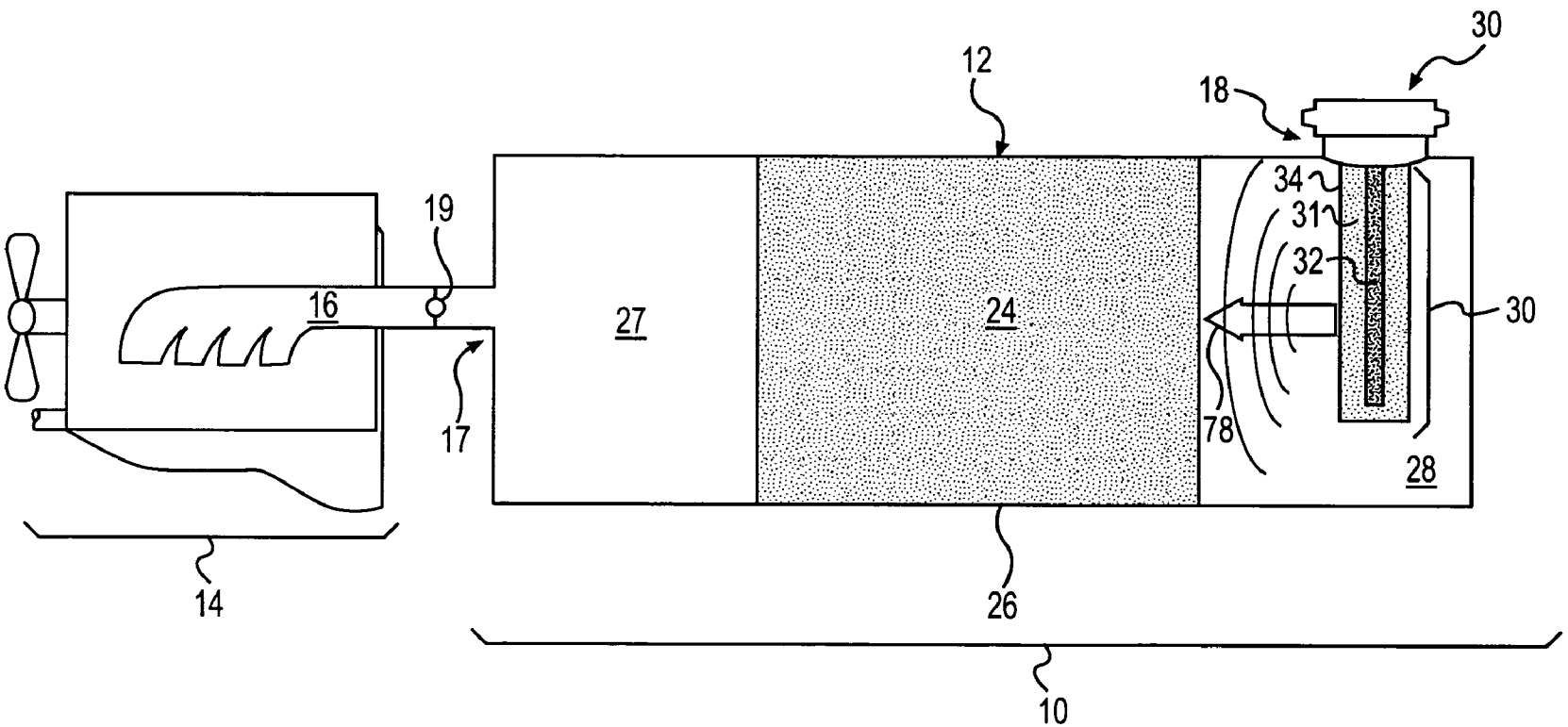
FIG. 2 is a diagrammatic illustration of another exemplary disclosed filter purge system.

Referring to FIG. 2, an alternative embodiment of filter purge system 10 may include propellant 31 extending into outlet end cap 28, and igniter 32 being located within propellant 31. The placement of propellant 31 as illustrated in FIG. 2 may help to ensure that the impact wave generated by the reaction of propellant 31 is evenly distributed across filter media 24.

Figure 3:
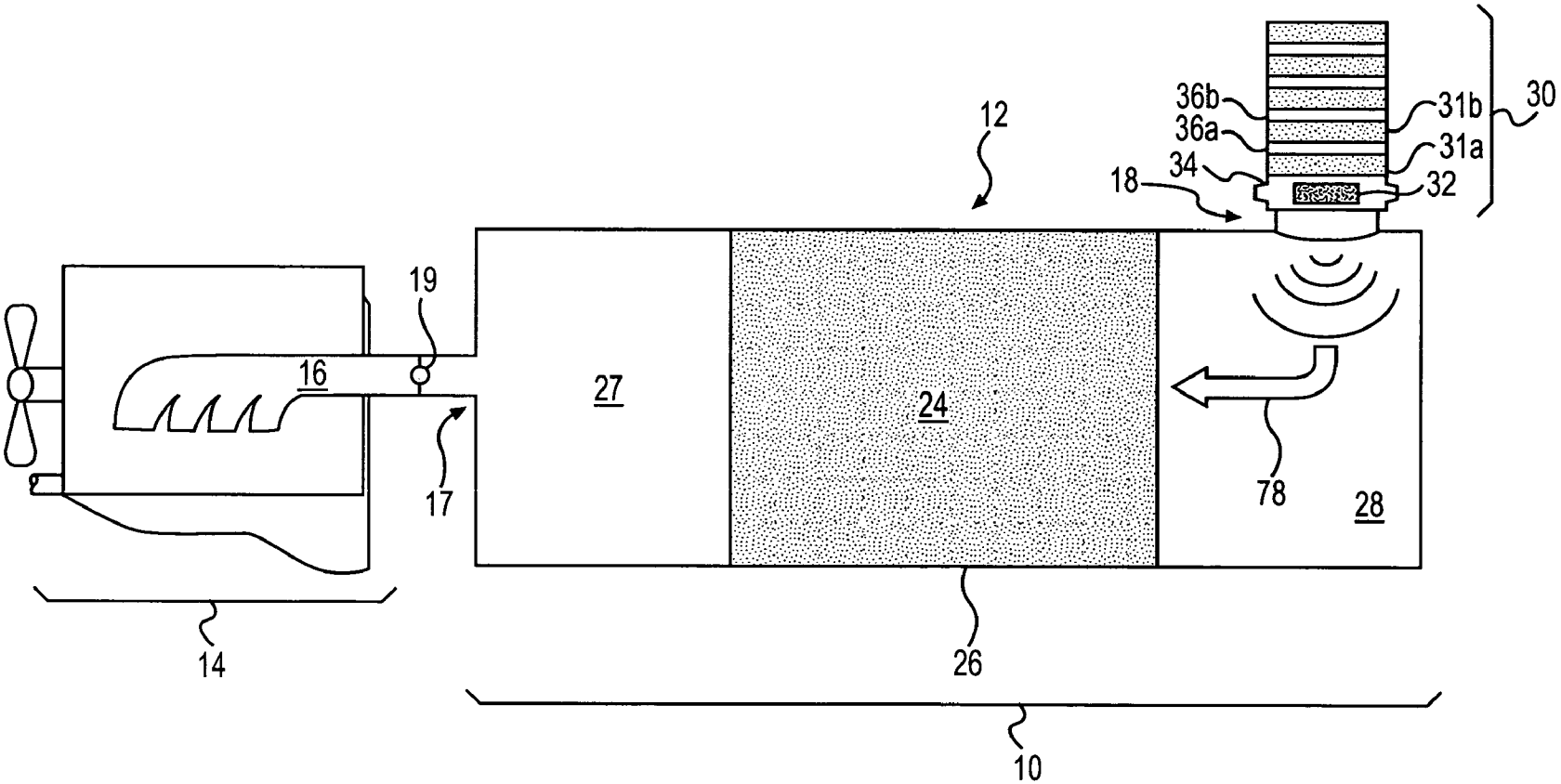
FIG. 3 is a diagrammatic illustration of another exemplary disclosed filter purge system.

Referring to FIG. 3, propellant system 30 may further include layers 36*a* and 36*b* of a slow burning material 36 positioned between layers of propellant 31. The use of slow burning material 36 may allow a single ignition event to set off a series of impact waves, generated by reactions of layers 31*a* and 31*b* of propellant 31. The layer quantity and spacing of slower burning material 36 may be thus controlled in order to achieve the desired duration of a single impact wave-generating reaction and the interval between such reactions.

Figure 4:
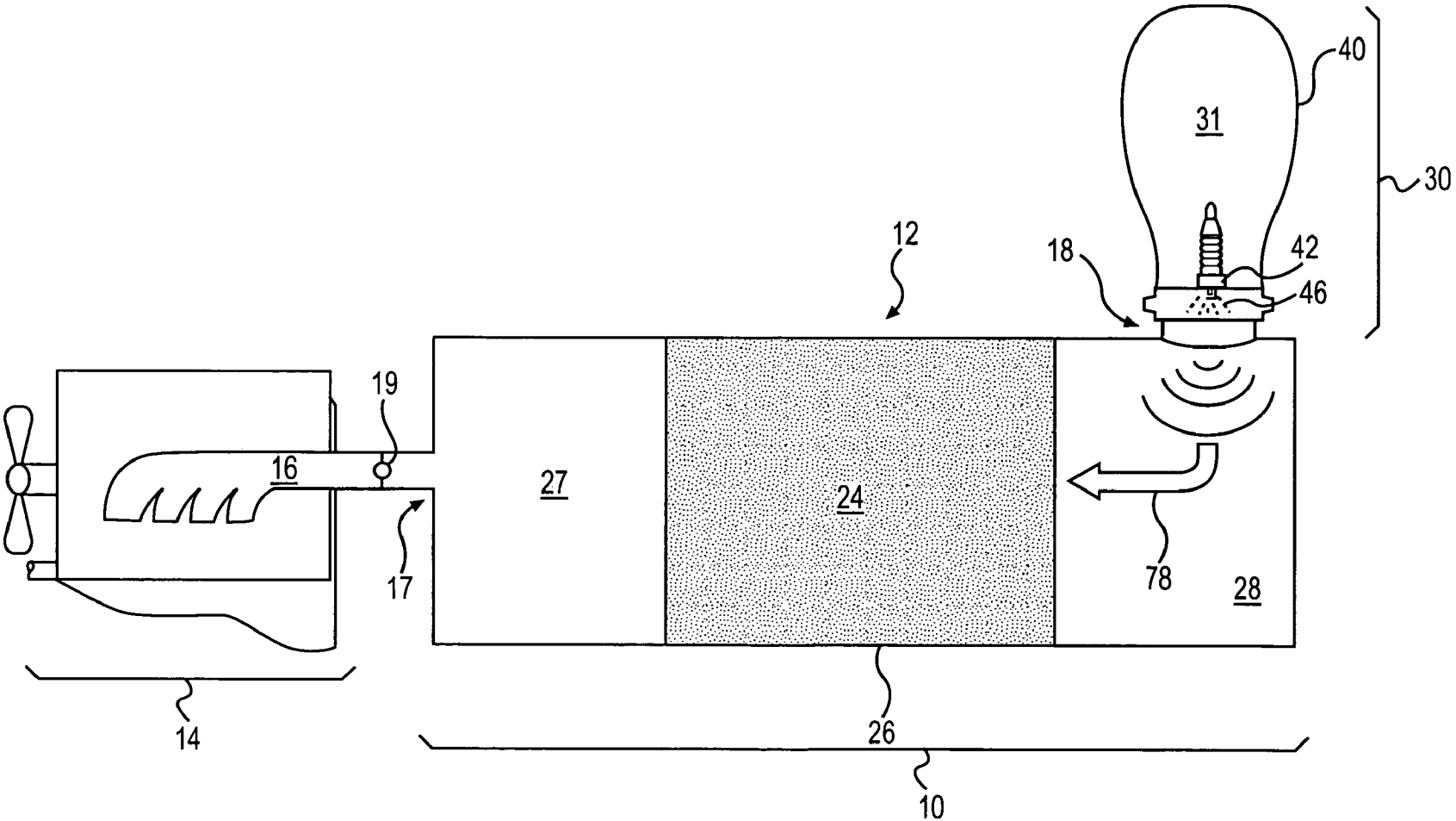
FIG. 4 is a diagrammatic illustration of yet another exemplary disclosed filter purge system.

Referring to FIG. 4, it is further considered that propellant 31 may alternatively embody a gaseous propellant. Gaseous propellant 31 may be, for example, propane or any other combustible gas contained within a tank 40. Gaseous propellant 31 may be released from tank 40 through a nozzle 42 into outlet end cap 28 where it may mix with oxygen and be ignited by a spark plug 46.

INDUSTRIAL APPLICABILITY

The disclosed filter purge system may be used with any filtering device and power source known in the art. The filtering device may be used, for example, with diesel, gasoline, gaseous fuel powered or other combustion engines or furnaces known in the art to remove particulate matter from a flow of exhaust. The disclosed filter purge system may be located on-board of the engine or furnace and may remove particulate matter captured within the filtering device. The operation of filter purge system 10 will now be explained in detail.

A variety of different methods and systems may be used to remove matter from a filtering device. For example, some filter devices may be cleaned through regeneration. During regeneration, a heat source may be used to increase the temperature of the filter device to combustion or oxidation levels. The heat source may also increase the temperature of particulate matter trapped in the filtering device above a combustion or oxidation temperature of the particulate matter, thereby burning away most of the collected particulate matter and regenerating the filter. Although regeneration may reduce the buildup of particulate matter within the filter, regeneration does not remove all particulate matter. Remaining particulate matter, or ash, may become trapped in the filter system and may gradually build up and plug the filter device over time, and result in deterioration in filtering performance. Thus, in some situations, it is necessary to remove built-up ash from the filter device using other techniques and systems.

Referring to FIG. 1, under normal operation of engine 14, exhaust line 16 may be coupled to filter 12 and inlet valve 19 may be open to facilitate passage of an exhaust flow from the engine 14. As illustrated by a flow arrow 72, the exhaust flow may exit engine 14, and pass through exhaust line 16 and open inlet valve 19. From inlet valve 19, the exhaust flow may enter filter 12 through inlet 17 and travel across at least a portion of filter media 24, as illustrated by a flow arrow 74. During normal operation of engine 14, propellant arrangement 30 may be uncoupled from outlet 18 (not shown) so that exhaust may pass through outlet 18 substantially unrestricted.

Over time, the sensor may sense an increase in the pressure drop across filter media 24, indicating a saturation of filter media 24. Based on these readings, filter purge system 10 may undergo regeneration either automatically, or as a result of some operator input. As described above, the regeneration process may not remove all the matter entrained in filter media 24, and ash may build up in filter media 24. Filter purge system 10 of the present disclosure may be activated to assist in removing the ash collected within filter media 24. It is understood that filter purge system 10 may also be used to assist in the removal of soot and/or other matter collected within the filter media 24.

To begin the removal of ash from filter 12, engine 14 may be turned off such that combustion ceases and substantially no exhaust flows from engine 14 to exhaust line 16. Propellant system 31 may be attached to outlet 18. Inlet valve 19 may be positioned to direct flow away from engine 14 and/or exhaust line 16 may be uncoupled from inlet 17.

Filter purge system 10 may be activated and igniter 32 may emit an electrical spark to ignite solid propellant 31 and initiate the oxidation reaction thereof. For example, solid propellant 31, composed of GUDN and AN, may react producing carbon dioxide, nitrogen, water vapor, and an impact wave (i.e. a burst of gas) with an adequate mass flow rate and duration to remove matter entrained within filter media 24. The duration and force of the impact wave may be dependant on the geometry of filter 12. The impact wave may, for example, have a mass flow rate of about 15 kg/s and a duration of at least about 10 ms. The impact wave may be directed through filter media 24 in the direction indicated by a flow arrow 78, and result in a pressure drop of approximately 5-7 psi across filter media 24. As the impact wave travels across filter media 24, entrained particulate matter may be dislodged from filter media 24 and blown into inlet end cap 27. It is considered that substantially all of the energy of each impact wave may be consumed by the passage of the wave through filter media 24. Following the first reaction of solid propellant 31, igniter 32 may initiate further reaction events at intervals of approximately 100 ms until substantially all the entrained particulate matter has been removed from filter media 24. It is considered that igniter 32 may be controlled by a timing device (not shown).

Referring to FIG. 3, it is further considered that a single event of igniter 32 may initiate a chain of impact wave-generating reactions of propellant 31. For example, the ignition event may initiate a reaction of propellant 31, as discussed above. Propellant 31 may react, consuming substantially all of first solid propellant layer 30*a* within, for example, about 10 ms. The reaction may then consume slower burning layer 36*a* within, for example, about 100 ms, and then reach second solid propellant layer 30*b* and consume that layer within about the same time required to consume first solid propellant layer 30*a*. This cycle of burning solid propellant 31 and slower burning material 36 may repeat until substantially all of solid propellant 31 has been consumed. Once the ash is broken free, it may be removed from inlet end cap 27 by a vacuum or other means.

Referring to FIG. 4, it is further considered that the impact wave may be generated by the combustion of gaseous propellant 31. Gas propellant 31 may be released from tank 40 through nozzle 42 and into outlet end cap 28, where it may mix with oxygen and be ignited by spark plug 46. The combustion of gas propellant 31 may initiate an impact wave that may be directed across filter media 24 in a manner similar to that described above.

Several advantages may be associated with the disclosed filter purge system. Specifically, the disclosed system method may use readily available solid or gas propellant to create an impact wave that may remove entrained matter from a filter. The impact wave generated by the propellant may be distributed evenly across the filter such that the system may remove substantially all the matter entrained within the filter. Furthermore, the disclosed system may remove matter from a filter without the need for a redundant filter system or large and costly valve systems.

It will be apparent to those skilled in the art that various modifications and variations can be made to the disclosed filter purge system. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A filter purge system, comprising:

a filtering device located in a conduit, the conduit defining an axial direction;

a reactive propellant located downstream of the filtering device, the reactive propellant including a plurality of layers of solid propellant arranged in a series; and an igniter and positioned adjacent one end of the series of layers of reactive propellant, such that activation of the igniter triggers the layers of solid propellant to ignite in sequence to generate multiple impact waves.

2. The system of claim 1, wherein an interval between consecutive impact waves is approximately 100 ms.

3. The system of claim 1, wherein a duration of at least one of the impact waves is approximately 10 ms.

4. The system of claim 1, wherein at least one of the impact waves results in a mass flow rate of approximately 15 kg/s.

5. The system of claim 1, wherein at least one of the impact waves results in a pressure drop of approximately 5-7 psi across the filtering device.

6. The system of claim 1, further including a housing that contains the filtering device and the propellant.

7. A method for removing matter from a filtering device comprising:

initiating a combustion event using a series of layers of solid propellant, including igniting the layers of solid propellant in sequence to generate multiple impact waves; and directing the impact wave across the filtering device.

8. The method of claim 7, wherein initiating the combustion event includes igniting the series of layers of solid propellant.

9. The method of claim 7, wherein an interval between the consecutive impact waves is at least 100 ms.

10. The method of claim 7, wherein directing the impact waves across the filtering device includes generating a mass flow rate of approximately 15 kg/s through the filtering device.

11. The method of claim 7, wherein directing the impact waves across the filtering device results in a pressure drop of approximately 5-7 psi through the filtering device.

12. The method of claim 7, wherein directing the impact waves across the filtering device includes directing at least one of the impact waves though the filtering device for approximately 10 ms.

13. An exhaust treatment system comprising:

an engine configured to produce power and a flow of exhaust;

a particulate filter situated to receive the flow of exhaust from the engine;

a plurality of layers of a reactive propellant, each layer being separated by another substance, the reactive propellant located downstream of the particulate filter; and an igniter configured to initiate a reaction of at least one of the plurality layers of propellant to generate an impact wave that dislodges matter from the particulate filter.

14. The exhaust treatment system of claim 13, wherein the propellant includes at least one of a solid propellant or a gaseous propellant.

15. The exhaust treatment system of claim 13, wherein the impact wave results in a pressure drop of approximately 5-7 psi across the particulate filter.

16. The exhaust treatment system of claim 8, wherein the ignition is initiated by an igniter located coaxial to the filtering device.

17. The exhaust treatment system of claim 13, wherein:

the plurality of layers of reactive propellant are arranged in a series; and the igniter is disposed adjacent one end of the series, such that activation of the igniter triggers the layers of reactive propellant to ignite in sequence to generate multiple impact waves.

18. The exhaust treatment system of claim 13, further comprising an inlet valve disposed upstream of the particulate filter and operable when closed to isolate the particulate filter from the engine.

19. The filter purge system of claim 1, further comprising an inlet valve disposed upstream of the filtering device and operable when closed to isolate the filtering device from an engine disposed upstream of the filtering device.

20. The method of claim of claim 7, further comprising selectively isolating an upstream side of the filtering device from an engine by closing an inlet valve disposed upstream of the filtering device.

* * * * *